US005603466A

United States Patent [19]

Alexander, III

[11] Patent Number: 5,603,466

[45] Date of Patent: Feb. 18, 1997

[54] ACCUMULATOR APPARATUS AND METHOD FOR USE WITH A WEB PRODUCING MACHINE

[76] Inventor: William J. Alexander, III, P.O. Box 848, Mauldin, S.C. 29662

[21] Appl. No.: 489,020

[22] Filed: Jun. 8, 1995

[51] Int. Cl.[6] ..... B65H 23/18

[52] U.S. Cl. ..... 242/413.5

[58] Field of Search ..... 242/413.3, 413.4, 242/413.5, 413.6, 413.7, 413.8, 542; 139/309, 311

[56] References Cited

U.S. PATENT DOCUMENTS

| | | | |
|---|---|---|---|
| 1,968,636 | 7/1934 | Dickhaut | 242/413.4 |
| 3,341,148 | 9/1967 | Cooper | 242/413.6 |
| 3,365,143 | 1/1968 | Espel | 242/413.5 |
| 3,813,053 | 5/1974 | Butler, Jr. et al. | 242/412.3 |
| 3,927,844 | 12/1975 | Bond et al. | 242/413.5 |
| 4,146,190 | 3/1979 | Bond et al. | 242/413.5 |
| 4,203,563 | 5/1980 | Alexander, III et al. . | |
| 4,216,804 | 8/1980 | Alexander, III et al. | 191/311 |
| 5,289,087 | 2/1994 | Summey, III | 242/412 |
| 5,299,753 | 4/1994 | Alexander, III | 242/412.1 |
| 5,314,128 | 5/1994 | Alexander, III | 242/534.2 |
| 5,443,226 | 8/1995 | Alexander, III et al. | 242/533.8 |

*Primary Examiner*—John P. Darling
*Attorney, Agent, or Firm*—Ralph Bailey

[57] ABSTRACT

A method of temporarily accumulating a web (W) when delivered from a producing machine includes the step of lengthening a vertical path of the web passing over an upper guide (A) downwardly over an oscillator roll (B) on a web takeup driven by a motor (C) controlled by movement of a compensator roll (D) in response to variations in web tension as for avoiding a necessity of stopping the producing machine when doffing a web roll from the takeup.

5 Claims, 2 Drawing Sheets

ACCUMULATOR APPARATUS AND METHOD FOR USE WITH A WEB PRODUCING MACHINE

BACKGROUND OF THE INVENTION

This invention relates to method and apparatus for taking up a web, as from a loom, utilizing an oscillator roll moved in response to variations in web tension to lengthen a path in which the web must move to a takeup during a temporary change in the operation of the takeup.

It is a general practice in loom takeups to utilize a sensor including a pivoted compensator roll such as illustrated in U.S. Pat. No. 4,216,804 to control cloth tension. Oscillations of the compensator roll take place in response to variations in tension in the cloth produced by the loom.

When utilizing the sensor mechanism of U.S. Pat. No. 4,216,804 in connection with a loom, a suitable doffing mechanism as illustrated as in U.S. Pat. No. 4,203,563 is also often utilized. In such doffing arrangements the doffing mechanism may be engaged automatically or by moving a hand-operated lever as shown in U.S. Pat. No. 4,203,563. When a large web roll, which may weigh on the order of 6,000 pounds, is doffed it has been necessary to either slow the weaving machine or loom down or to stop it altogether depending on the length of time required for carrying out the doffing cycle. Such stoppage of the loom results in lost production time with possible reduction in product quality brought about by the necessity of stopping and then restarting the loom. Increased time is spent by production personnel as a result of such stopping and starting of the loom with increased maintenance as a result of wear and tear on the loom mechanism.

While the sensor and doffing apparatus utilized in connection with the takeup has been described in specific terms, it is to be understood that any suitable sensing mechanism or doffing mechanism may be employed utilizing the subject invention.

SUMMARY OF THE INVENTION

When taking up a web into a large web roll, such as in a cloth web delivered from a producing machine, such as a loom, it is desired to be able to doff the web roll as to otherwise service suitable takeup apparatus without the necessity for reducing the speed or stopping the producing machine.

Accordingly, it is an important object of the invention to provide an accumulator apparatus engageable by the web when moved in an upright path responsive to variations in tension in the web as may occur as a result of stopping of a takeup during doffing. In accordance with the prior art, actuation of the doffing apparatus requires that a loom be stopped otherwise a switch as illustrated in U.S. Pat. No. 4,216,804 is actuated when the compensator roll moves downwardly responsive to reduced web tension.

Another important object of this invention is to provide an accumulator apparatus, and method wherein a compensator or dancer roll moves responsive to variations in cloth tension as occurs during doffing of a takeup, to lengthen the path of travel of the web thus accumulating the web so as to permit the producing machine to continue to run during the cycle of doffing and the like. The invention contemplates the provision of an oscillator roll engaging the web proceeded from the loom which is movable responsive to tensions in the web to vary the length in the path so as to accumulate the web produced by the producing machine which continues as during doffing of the takeup. The compensator roll, which is also positioned in the path of the web moves downwardly as a result of reduced web tension, upon stopping of the takeup mechanism during doffing and it is preferred that the compensator be heavier or be biased as by springs or weights exert a greater force than the accumulator roll so that the takeup may be stopped before the accumulator roll comes into action to cause the accumulation of the web.

While this invention is described in the context of a loom takeup it is to be understood that the invention may leave general application to the taking up of a web by the use of an accumulator so as to avoid the necessity for varying the speed of web delivery apparatus or the stopping thereof altogether in order to doff or otherwise service the takeup.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an accumulator apparatus and method for use in a take up for winding a web from a producing machine into a web roll. Means are provided for guiding the web proceeding from the producing machine on a downward path preparatory to being wound on the web roll including an upper guide member A. The means guiding said web further includes an accumulator roll B engaging the web proceeding from the producing machine and is movable responsive to variations in tension in the web to vary the length of the path. Means for driving the web roll for taking up the web thereon include a motor C. Sensing means, including a compensator roll D, is positioned in the path engaging the web controlling the output of the means driving said web roll. Thus, the takeup may vary its speed or discontinue operation without necessitating a change in the operation of the producing machine.

Figure 1:
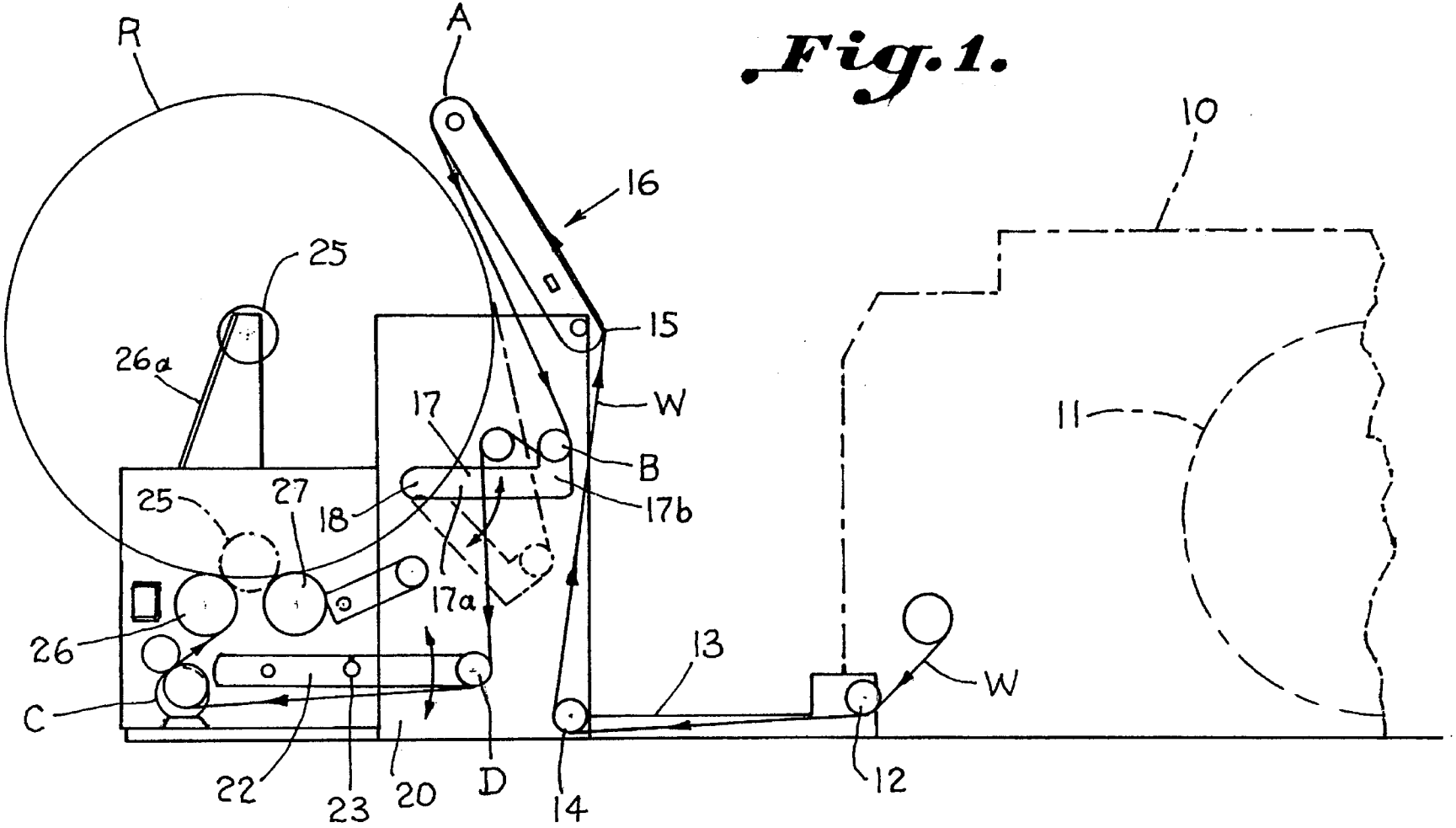
FIG. 1 is a side elevation illustrating an accumulator apparatus and method in accordance with the invention showing the upward path of cloth produced by a loom over an inspection apparatus in the form of a light box and thence downwardly over a pivoted accumulator roll and over a compensator roll so as to permit the producing machine to produce fabric during the doffing of the web roll from the takeup.

FIG. 1 illustrates a producing machine in the form of a weaving machine broadly designated in broken lines at 10. The weaving machine has a warp beam illustrated at 11 from which a cloth web W is woven and delivered over a guide roll 12 beneath a worker's platform 13 to a guide roll 14 preparatory to passing upwardly and over the lower arcuate surface 15 of a light box broadly designated as at 16. The web W then passes over the upper guide member designated as at A and thence downwardly over an accumulator roll B. The accumulator or oscillator roll B is carried by a suitable lever or accumulator crank arm 17 which is pivoted as at 18. The accumulator arm 17 includes an elongated link 17*a* which is pivotally carried as at 18 on one end while a shorter link 17*b* at right angles thereto is pivotal at the other end for positioning the accumulator roll B between the spaced crank arms 17. The crank arms are located adjacent respective side frame members 20 as best illustrated in FIG. 1. The accumulator apparatus further includes a guide roll 21 about which the web passes its way to the compensator roll D. The web W passes over the compensator roll D on a substantially horizontal path as shown in FIGS. 1 and 2 before proceeding to the takeup.

Figure 2:
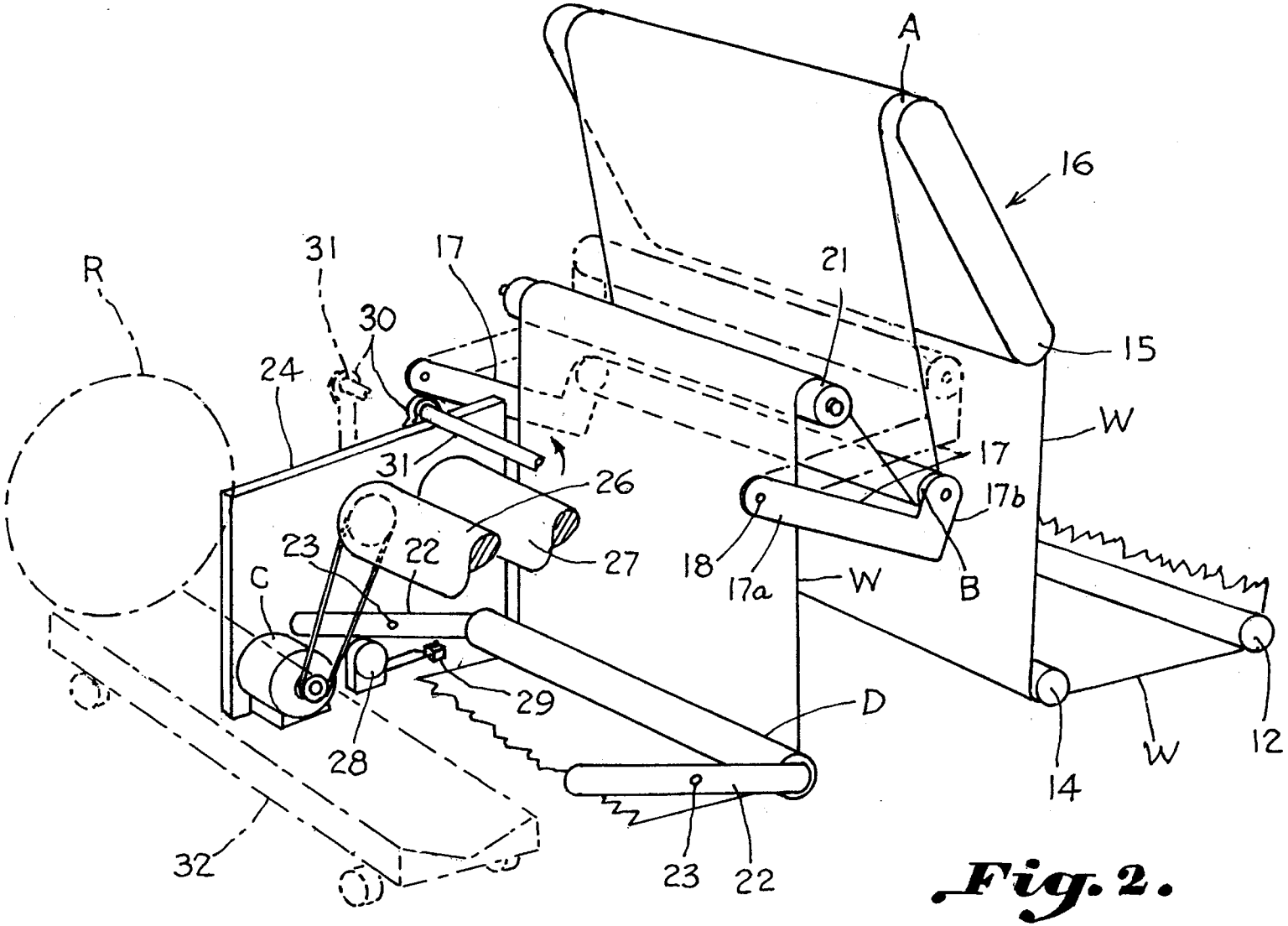
FIG. 2 is a perspective view further illustrating the accumulator apparatus with the accumulator roll support arms in lowered position having increased the length of the path of the cloth preparatory to being received by the compensator roll which is illustrated in fully lowered position engaging the switch mechanism to de-activate a surface wound takeup.

The compensator roll D is carried by respective arms 22 pivoted as at 23 intermediate their ends on respective side frame members 24 as shown in FIGS. 1 and 2. The web roll R is built upon a suitable core 25 carried between respective core guides 26*a* as in FIG. 1. The web roll R is carried between the surface wind rolls 26 and 27 which are driven by the motor C. The motor C is driven by a suitable speed controlling mechanism illustrated as at 28 responsive to engagement of the switch 29 by an adjacent arm 22 which pivotally supports the oscillator roll D.

When the cloth web W becomes sufficiently relaxed due to doffing of the roll R as illustrated as in FIG. 2, the compensator roll D moves downwardly permitting the arm 22 to engage the switch 29 for suitably controlling the speed mechanism illustrated as at 28. FIG. 2 illustrates the use of doffer arms 30 for carrying a doffer roll 31 therebetween for moving the roll R onto a suitable cart illustrated in FIG. 2 as at 32.

It is thus seen that an accumulator apparatus and method has been provided wherein slack in the tension of the web W as occurs during doffing causing the compensator roll D to move downwardly in response to the force of gravity as shown in FIG. 2 to engage the switching mechanism 29 for stopping the takeup. After this action has occurred the tension in the fabric becomes less permitting the accumulator roll B to lower on an arcuate path as illustrated by the arrow in FIG. 1 to a lower position thus increasing the length of web permitting an upward run of the web W preparatory to passing over the roll 21 rotatably mounted about a horizontal axis between respective frame members 20.

It is thus seen that the many advantages of avoiding stopping and then restarting a production machine may be achieved by simple automatically operable apparatus and method wherein a vertical path of travel of a web to a takeup is temporarily increased due to movement of an oscillator roll.

While a preferred embodiment of the invention has been described using specific terms, such description is for illustrative purposes only, and it is to be understood that changes and variations may be made without departing from the spirit or scope of the following claims.

What is claimed is:

1. Accumulator apparatus for use in a takeup driving a web roll for winding a web from a producing machine comprising:

means guiding said web proceeding from said producing machine on a downward path preparatory to being wound on said web roll;

said means guiding said web including a stationary upper guide member over which said web passes downwardly;

an oscillator roll engaging said web proceeding from said producing machine on said downward path and being movable responsive to variations in tension in said web to vary the length of said downward path;

means driving said web roll for taking up said web thereon; and tension sensing means at a lower end in said path engaging said web moving downwardly from said oscillator roll controlling said takeup driving said web roll;

whereby varying the length of said path permits said takeup to vary its speed or discontinue operation without necessitating a change in the operation of the producing machine.

2. The structure set forth in claim 1 wherein said producing machine is a loom producing a cloth web; a pivotal support for said oscillator roll maintaining said oscillator roll in supported relation on said cloth web; said sensing means including a pivoted compensator roll supported by said cloth web, said cloth web being received by said compensator roll from said oscillator roll.

3. The structure set forth in claim 2 wherein said compensator roll exerts a greater force on said cloth web than does said oscillator roll.

4. The method of winding a web from a producing machine into a web roll having a takeup driving the web roll comprising the steps of:

guiding said web proceeding from said producing machine on a downward path preparatory to being wound on said web roll;

providing an oscillator roll engaging said web on said downward path;

moving said oscillator roll responsive to variations in tension in said web to vary the length of said path;

driving said web roll for winding the web thereon; and providing a roll forming a lower end of said downward path sensing the tension in said web controlling the driving of said web roll;

whereby said takeup may temporarily vary its speed or discontinue operation without necessitating a change in the operation of the producing machine.

5. The method set forth in claim 4 including the steps of:

pivotally mounting said oscillator roll; and providing a pivotal mounting for said sensing roll exerting a greater force upon the web than said oscillator roll so as to assume an extreme position prior to movement of the oscillator roll responsive to an increase in web tension.

* * * * *